United States Patent [19]

Braun

[11] Patent Number: 4,513,302

[45] Date of Patent: Apr. 23, 1985

[54] PRESSURE-SENSITIVE OR HEAT-SENSITIVE RECORDING MATERIAL

[75] Inventor: Rosalinde Braun, Riehen, Switzerland

[73] Assignee: Ciba-Geigy Corporation, Ardsley, N.Y.

[21] Appl. No.: 504,712

[22] Filed: Jun. 15, 1983

[30] Foreign Application Priority Data

Jun. 24, 1982 [CH] Switzerland ..... 3886/82
Jan. 20, 1983 [CH] Switzerland ..... 318/83

[51] Int. Cl.[3] ..... B41M 5/16; B41M 5/18; B41M 5/22

[52] U.S. Cl. ..... 346/210; 346/211; 346/212; 346/216; 346/225; 427/151

[58] Field of Search ..... 282/27.5; 427/150–153; 428/320.4–320.8, 411, 488, 537, 913, 914; 346/210–212, 216, 225

[56] References Cited

FOREIGN PATENT DOCUMENTS 54-8016 1/1979 Japan ..... 428/210

*Primary Examiner*—Bruce H. Hess
*Attorney, Agent, or Firm*—Edward McC. Roberts

[57] ABSTRACT

A pressure-sensitive or heat-sensitive recording material, comprising a support, having a developer or both a color former and a developer in or on the support, wherein the developer consists of a metal complex compound of the formula $$(R)_{k-n}Me(An)_{n/r} \quad (I)$$

wherein

Me is an n-valent metal ion,

R is a unidentate or polydentate colorless organic ligand which is complexed with the metal ion through heteroatoms, An is a r-valent anion, k is the coordination number 4 or 6 of the metal ion, depending on the metal, n is 1, 2, 3 or 4, and r is 1 or 2.

21 Claims, No Drawings

PRESSURE-SENSITIVE OR HEAT-SENSITIVE RECORDING MATERIAL

The present invention relates to a pressure-sensitive or heat-sensitive recording material which contains in its color reactant system, as developer for the color former, at least one metal complex compound of the formula $$(R)_{k-n}Me(An)_{n/r} \quad (1)$$

wherein

Me is an n-valent metal ion,

R is a unidentate or polydentate colorless organic ligand which is complexed with the metal ion through heteroatoms, An is an r-valent anion, k is the coordination number 4 or 6 of the metal ion, depending on the metal, n is 1, 2, 3 or 4, and r is 1 or 2.

The metal complex compounds employed in this invention are advantageously derived from divalent, trivalent or quadrivalent metals having an atomic weight of 24 to 210, preferably of 40 to 140 and most preferably of 50 to 120. Examples of such metals are aluminium, barium, lead, cadmium, calcium, chromium, iron, gallium, cobalt, copper, magnesium, manganese, molybdene, nickel, mercury, silver, strontium, tantalium, titanium, vanadium, tungsten, zinc, tin and zirconium. Preferred metals are barium, cadmium, calcium, manganese, strontium, titanium, vanadium, tin and, in particular, zinc.

The colorless organic ligand of the metal complex compounds of the invention can be complexed with the metal ion Me through 1, 2 or 3 heteroatoms, depending on the meaning of R and (k−n). Examples of suitable heteroatoms are nitrogen, oxygen, sulfur, selenium or phosphorus, with nitrogen being preferred.

The (k−n) ligands R in the metal complex compound of the formula (1) used as color developer may be identical or different. Preferably they are identical and are unidentate ligands. The difference of k minus n may not be 0. The preferred value of k is 4 and that of n is 2. Usually r is 1.

The colorless ligand of the metal complex compounds of this invention is preferably complexed with the metal ion through nitrogen atoms which are present in unidentate, bidentate or tridentate molecules, and occur for example in primary, secondary or tertiary amino groups, unsubstituted or substituted imino groups, nitrilo groups, oximido groups, hydrazine groups or hydrazone groups.

Suitable nitrogen-containing unidentate (monofunctional) ligands may e.g. aliphatic, cycloaliphatic, aromatic, araliphatic or heterocyclic amines, as well as secondary or tertiary saturated or unsaturated nitrogen-containing heterocyclic ring systems the nitrogen atoms of which are members of one or more rings.

Typical examples of aliphatic, cycloaliphatic and araliphatic nitrogen-containing ligands are: $C_1$–$C_{18}$ alkylamines, e.g. methylamine, ethylamine, n-propylamine, isopropylamine, n-butylamine, n-hexylamine, n-octylamine, isooctylamine, n-decylamine, n-dodecylamine or octadecylamine (stearylamine); cycloalkylamines such as cyclopentylamine and cyclohexylamine; benzylamine, 4-methylbenzylamine and α- or β-phenylethylamine. Particularly preferred is α-phenylethylamine.

Examples of suitable secondary N-heterocyclic systems are: pyrrolidine, piperidine, pipecoline, morpholine, thiomorpholine, imidazoline, indoline, benzomorpholine, benzimidazoline, tetrahydroquinoline or 2,2,4-trimethyltetrahydroquinoline.

The colorless organic ligands of the metal complex compounds employed in this invention are preferably unidentate aromatic amines or, in particular, aromatic N-heterocyclic systems.

Examples of suitable aromatic amines are: aniline, ring-substituted aniline, e.g. 2-, 3- or 4-methylaniline, chloroaniline, methoxyaniline, dichloroaniline and N-alkylated or N,N-dialkylated aniline, e.g. N-methylaniline, N-ethylaniline, N,N-dimethylaniline or N,N-diethylaniline, and also diphenylamine, 4,4'-diaminodiphenyl ether, 4,4'-diaminodiphenylsulfide, 4,4'-diaminodiphenylsulfone, or 4,4'-diaminodiphenylalkanes such as 4,4'-diaminodiphenylmethane or 4,4'-diaminodiphenylethane; and 4,4'-diaminoazobenzene.

Particularly preferred organic ligands are 5- or 6-membered aromatic N-heterocyclic systems which may be substituted by $C_1$–$C_{18}$alkyl, preferably $C_1$–$C_4$alkyl, $C_1$–$C_4$alkoxy, cyano, hydroxy, vinyl, phenyl, $C_1$–$C_4$acyl or amino groups, and/or are fused to benzene rings which may be substituted by e.g. halogen, $C_1$–$C_4$alkyl or $C_1$–$C_4$alkoxy.

Examples of such ligands are: pyrrole, 2,4-dimethylpyrrole, pyrrolidone, imidazole, 1-methylimidazole, 2-methylimidazole, 1-vinylimidazole, 2-phenylimidazole, pyrazole, 3,4-dimethyl-5-pyrazolone, triazoles, pyridine, α-, β- or γ-picolines, lutidines, collidines, parvolines, conyrines, methoxypyridines, aminopyridines, e.g. 3-aminopyridine, 2,3-diaminopyridine, 2,6-diaminopyridine, 4-formylpyridine, 4-cyanopyridine, pyrimidine, pyrazines, triazine, melamine, guanamines, ammeline, quinoline, 2-ethylquinoline, isoquinoline, quinaldine, quinazoline, quinoxaline, phthalazine, cinnoline, indolizine, indoles, e.g. 2-methylindole or 2-phenylindole, benzimidazole, 2-methylbenzimidazole, 1,2-dimethylbenzimidazole, 2-stearylbenzimidazole, 2-aminobenzimidazole, benzoxazole, benzothiazole, 2-thiobenzothiazole, 2-aminobenzothiazole, benzotriazole, carbazole, acridine, phenazine, antipyrine, diguanamines, guanidines, bipyridyl, 2,6-(di-2-pyridyl)pyridine (terpyridyl), phenanthridine, phenanthroline or dipyridylketone.

Particularly preferred metal complex compounds contain pyridines, picolines, imidazoles, benzimidazoles, benzothiazoles or quinolines as colorless heterocyclic ligands R.

R may also denote nitrogen-containing ligands which are at least bidentate (bifunctional). The nitrogen atoms through which metal is bound in the ligand molecule are preferably separated from each other by 2- or 3-membered saturated or unsatuated chains consisting of carbon atoms or of carbon atoms and nitrogen atoms. Examples of such ligands are alkylenediamines, e.g. ethylenediamine or propylenediamine, and phenylenediamines, as well as dialkylenetriamines and the triaminoalkanes. Examples of dialkylenetriamines are diethylenetriamine, monoethylene-monopropylenetriamine, dipropylenetriamine and their N-alkylated products. Examples of triaminoalkanes are α,β,γ-triaminopropane, α,β,δ-triaminobutane or α,γ-diamino-β-(aminoethyl)propane. The nitrogen atoms through which metal is bound and the carbon atoms linking them may also be members of a heterocyclic ring or ring system. Typical examples of such bidentate N-containing ligands are piperazine, imidazolidine and diazabicyclo[2,2,2]octane.

Other suitable nitrogen-containing ligands are hydrazines, e.g. hydrazine, $C_1$–$C_5$alkylhydrazines, arylhydrazines such as phenylhydrazine, hydrazones such as acetone hydrazone, acetophenone hydrazone, hydrazides such as acethydrazide or benzhydrazide, hydroxylamine, amidines such as formamidine, amides such as formamide, dimethylformamide, diethylformamide, tetramethylurea, acetamide or benzamide, as well as oximes, e.g. acetaldoxime or acetoxime.

The ligands R present in the metal complex compounds of this invention can also coordinate through oxygen, sulfur or phosphorus.

Examples of suitable organic ligands which coordinate through oxygen or sulfur are carbonyl compounds, e.g. benzophenone, pyrone, amine oxides, phosphine oxides, e.g. triphenylphosphine oxide, and urea and thiocarbonyl compounds, e.g. thiourea and the corresponding substitution products such as 4,4'-bis(dimethylamino)benzophenone (Michler's ketone). Further S-containing ligands which may be mentioned by way of example are also mercaptans, e.g. 2-mercaptobenzthiazole, or thiones such as 1,3-dimethylimidazoline-2-thione. Organic ligands which are bound to the metal complex through phosphorus are e.g. phosphines such as triphenylphosphine.

Suitable anionic radicals An are both inorganic and organic anions. Depending on the value of r, the anions can be monovalent or divalent. Examples of inorganic anions are halides such as chlorides, bromides, fluorides or iodides; radical of sulfur-containing acids such as hydrogen sulfate, sulfate, disulfate or aminosulfate; radicals of oxyacids or phosphorus, e.g. dihydrogen phosphate, hydrogen phosphate, phosphate or metaphosphate; radicals of nitrogen-containing oxyacids, e.g. nitrate; radicals of carbonic acid, e.g. hydrogen carbonate or carbonate; anions of oxygen acids and complex acids, e.g. methosulfate, ethosulfate, hexafluorosilicate, cyanate, thiocyanate, hexacyanoferrate(II), hexacyanoferrate(III), tri- and tetrachlorozincate, tri- and tetrabromozincate, stannate, borate, divanadate, tetravanadate, molybdate, tungstenate, chromate, bichromate or tetrafluoroborate; and anions of esters of boric acid, e.g. of the glycerol ester of boric acid and of esters of phosphoric acid, e.g. methylphosphate.

Examples of organic anions are anions of saturated or unsaturated aliphatic, cycloaliphatic, aromatic, araliphatic or heterocyclic carboxylic acids or sulfonic acids.

Suitable aliphatic anions are e.g. radicals of acetic acid, haloacetic acid, aminoacetic acid, cyanoacetic acid, thioacetic acid, propionic acid, hydroxypropionic acid, butyric acid, halobutyric acid, thioglycolic acid, glyceric acid, malic acid, valeric acid, caproic acid, lauric acid, palmitic acid, stearic acid, oleic acid, ricinolic acid, coconut fatty acid, acrylic acid, methacrylic acid, crotonic acid, propargyl acid, oxalic acid, malonic acid, succinic acid, glutaric acid, adipic acid, pimelic acid, suberic acid, azelaic acid, sebacic acid, tartaric acid, citric acid, fumaric acid, maleic acid, itaconic acid, aminoethylsulfonic acid, nitrilosulfonic acid, methanesulfonic acid, ethanesulfonic acid or paraffinesulfonic acid (mersolate).

Examples of suitable cycloaliphatic anions are anions of cyclohexanoic acid or 3-cyclohexenoic acid.

Examples of suitable aromatic anions are anions of benzoic acid methylenebenzoic acids, tert-butylbenzoic acid, chlorobenzoic acids, nitrobenzoic acids, hydroxybenzoic acids, methoxybenzoic acids, aminobenzoic acids, phthalic acid, halophthalic acid, isophthalic acid, sulfobenzoic acid, benzenetetracarboxylic acid, abietic acid, hydroxynaphthoic acid, diphenylcarboxylic acid, naphthalenetetracarboxylic acid, benzenedisulfonic acid, toluenesulfonic acid or naphtholsulfonic acid.

Examples of suitable araliphatic anions are anions of phenylacetic acid, methylphenylacetic acid or mandelic acid.

Examples of suitable heterocyclic anions are anions of pyromucic acid, dehydromucic acid, indolyl-3-acetic acid or 5-quinolinesulfonic acid.

Preferred anions An are halides, e.g. chlorides, bromides or iodides, pseudohalides such as thiocyanates, and also nitrates, sulfates, phosphates or borates, as well as formates, acetates, propionates, citrates, stearates, benzoates, oxalates or phthalates. The most preferred anion An is a thiocyanate ion.

Interesting color formers are those of the formula

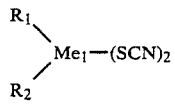

(2)

wherein $Me_1$ is an ion of a n-valent metal having an atomic weight of 40 to 140 and each of $R_1$ and $R_2$ independently of the other is a unidentate 5- or 6-membered N-heterocyclic ring system of aromatic character which is complexed with the metal ion through the nitrogen atom and which may be mono- or disubstituted by cyano, vinyl, formyl, phenyl, $C_1$–$C_{18}$alkyl or preferably methoxy, $C_1$–$C_4$alkyl or amino groups, or which contains a fused benzene ring, n is preferably 2, 3 or 4.

In formula (2) above, $Me_1$ is in particular a cadmium ion or, most preferably, a zinc ion. $R_1$ and $R_2$ are identical and each is preferably a pyridine, quinoline, imidazole or benzimidazole ligand which is complexed through the nitrogen atom and in which the N-heterocyclic ring is unsubstituted or substituted by methyl, methoxy, cyano, vinyl, formyl, phenyl or amino. Particularly preferred ligands $R_1$ and $R_2$ are pyridine, picoline, 2-methoxypyridine, quinoline, imidazole, benzimidazole and, especially benzothiazole, 1-methylimidazole or 2-methylimidazole.

Some of the compounds of the formulae (1) and (2) employed in this invention are known compounds, but constitute a class of novel color developers or electron acceptors for color formers. They can be obtained by methods which are known per se, for example by reacting—depending on the meaning of the ligand—1 mole of an inorganic or organic metal salt which contains, per metal atom, n/r moles of the inorganic or organic moiety, e.g. zinc thiocyanate or zinc acetate, with k−n molecules of the corresponding unidentate or polydentate ligand. This reaction is conveniently carried out in a polar solvent, with or without the addition of a small amount of catalyst.

Examples of suitable solvents are water or a water-miscible organic solvent. Examples of water-miscible solvents are: aliphatic $C_1$–$C_4$alcohols such as methanol, ethanol, the propanols or isobutanol; alkylene glycols, e.g. ethylene glycol or propylene glycol; monoalkyl ethers of glycols, e.g. ethylene glycol monomethyl, monoethyl or monobutyl ether, or diethylene glycol monomethyl or monoethyl ether; ketones such as acetone, methyl ethyl ketone, cyclohexanone or diacetone alcohol; ethers and acetals, e.g. diisopropyl ether, diphenyl oxide, dioxan, tetrahydrofuran; and tetrahydrofurfuryl alcohol, pyridine, acetonitrile, γ-butyrolactone, N,N-dimethylformamide, N,N-dimethylacetamide, tetramethylurea or tetramethylenesulfone.

The reaction may be carried out at room temperature (20°–25° C.), but sometimes more elevated temperatures are necessary, preferably in the range from 40° to 150° C. It is also possible to react the reactants in the melt. Suitable fusing assistants are e.g. salts of lower fatty acids, for example sodium acetate, amides of lower fatty acids, e.g. acetamide, and also urea or thiourea or their N-substitution products.

Metal thiocyanate complexes are preferably obtained by mixing solutions of a metal donor and an alkali metal thiocyanate or ammonium thiocyanate, preferably potassium thiocyanate, in one of the polar solvents specified above and then reacting the mixture with the desired ligand.

Preferred metal donors are the metal salts of mineral acids or of strong organic acids, in particular sulfates, halides (chlorides), nitrates, formates or acetates.

Known metal complex compounds of the formulae (1) and (2) and the preparation thereof are described e.g. in "Gmelins Handbuch der anorganischen Chemie", Vol. 32, page 271 (Zinc), and in Supplementary Volume (1956) "Zinc", pp. 986–987, and also in I. S. Ahuja and A. Garg. J. inorg. nucl. Chem. 34, 1929–19235 (1972).

The compounds of the formula (1) are substantially colorless and odorless and are very reactive with conventional color formers, so that spontaneous, stable and non-fading copies are obtained.

The color formers suitable for use in the recording or copying material of this invention are known colorless or faintly coloured chromogenic compounds which, on coming into contact with the metal complex compounds of the formula (1), become colored or change color. It is possible to use colour formers, or mixtures thereof, which belong to e.g. the classes of the azomethines, fluoranes, benzofluoranes, phthalides, spiropyranes, spirodipyranes, leucoauramines, triarylmethaneleuco dyes, carbazolylmethanes, chromenoindoles, chromenopyrazoles, phenoxazines, phenothiazines, as well as chromeno or chromano color formers.

Examples of such suitable colour formers are: crystal violet lactone (Registered Trademark), 3,3-(bisaminophenyl)-phthalides, 3,3-(bis-substituted indolyl)-phthalides, 3-(aminophenyl)-3-indolylphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or -3-lower alkylfluoranes, 6-dialkylamino-2-dibenzylaminofluoranes, 6-pyrrolidino-2-arylaminofluoranes, bis-(aminophenyl)-furyl-, -phenyl- or -carbazolylmethanes, 3'-phenyl-7-dialkylamino-2,2'-spirodibenzopyranes, bis-dialkylamino-benzhydrol-alkyl- or -arylsulfinates, benzoyldialkylaminophenothiazines or benzoyldialkylaminophenoxazines.

The compounds of the formula (1) are suitable for use as color developers in a pressure-sensitive or heat-sensitive recording material, which can also be a copying material.

A pressure-sensitive material consists for example of at least one pair of sheets, which contain at least one color former dissolved in an organic solvent, and a developer of the formula (1).

The developer is preferably applied in the form of a layer to the face of the receiver sheet.

The developers of the formula (1) may be used by themselves, in admixture with each other, or in admixture with known developers. Typical examples of such developers are activated clays such as attapulgite, acid clay, bentonite, montmorillonite, activated clay, e.g. acid-activated bentonite or montmorillonite, and also zeolith, halloysite, silica, alumina, aluminium sulfate, aluminium phosphate, zinc chloride, zinc nitrate, kaolin or any clay or acidic organic compound, for example unsubstituted or ring-substituted phenols, salicylic acid or salicylates and their metal salts, or an acidic polymer, for example a phenolic polymer, an alkylphenolacetylene resin, a maleic acid/rosin resin or a partially or completely hydrolysed polymer of maleic acid and styrene, ethylene or vinyl methyl ether, or carboxypolymethylene.

The developers may also be used with other basically inert or almost inert pigments or further auxiliaries such as silica gel or UV absorbers such as 2-(2-hydroxyphenyl)-benztriazoles. Examples of such pigments are: talcum, titanium dioxide, zinc oxide, chalk, clays such as kaolin, as well as organic pigments, e.g. urea/formaldehyde condensates (BET surface area 2–75 $g/m^2$) or melamine/formaldehyde condensates.

The color former effects a colored marking at those points where it comes into contact with the developer. In order to prevent the color formers contained in the pressure-sensitive recording material from becoming active prematurely, they are usually separated from the developer. This may conveniently be accomplished by incorporating the color formers in foamlike, spongelike or honeycomb-like structures. Preferably the color formers are enclosed in microcapsules, which as a rule can be ruptured by pressure.

When the capsules are ruptured by pressure, for example with a pencil, and the color former solution is transferred in this manner to an adjacent sheet which is coated with the developer of formula (1), a colored area is produced. This color results from the dye which is formed and which is absorbed in the visible range of the electromagnetic spectrum.

The color formers are encapsulated preferably in the form of solutions in organic solvents. Examples of suitable solvents are preferably nonvolatile solvents, for example a polyhalogenated paraffin such as chloroparaffin, or a polyhalogenated diphenyl such as monochlorodiphenyl as trichlorodiphenyl, and also tricresyl phosphate or di-n-butyl phthalate; an aromatic ether such as benzylphenyl ether; a hydrocarbon oil such as paraffin or kerosene; an alkylated (e.g. with isopropyl or isobutyl) derivative of diphenyl, a diphenyl alkane, naphthalene or triphenyl, dibenzyl toluene, terphenyl, partially hydrogenated terphenyl, a benzylated xylene, or other chlorinated or hydrogenated, condensed aromatic hydrocarbons. Mixtures of different solvents are often used in order to obtain an optimum solubility for the color formation, a rapid and intense coloration, and a viscosity which is advantageous for the microencapsulation.

The capsule walls can be formed evenly around the droplets of the color former solution by coacervation; and the encapsulating material may consist of gelatin and gum arabic, as described e.g. in U.S. Pat. No. 2,800,457. The capsules may also be formed preferably from an aminoplast or a modified aminoplast by polycondensation, as described in British patent specification Nos. 989 264, 1 156 725, 1 301 052 and 1 355 127. Also suitable are microcapsules which are formed by interfacial polymerisation, e.g. capsules formed from polyester, polycarbonate, polysulfonamide, polysulfonate, but in particular from polyamide or polyurethane.

The microcapsules containing the color formers may be used in combination with the developers for the production of a wide variety of known kinds of pressure-sensitive copying material. The various systems differ substantially from one another in the arrangement of the capsules, the color reactants, i.e. the developers, and the support. A preferred arrangement is that in which the encapsulated color former is in the form of a layer on the back of a transfer sheet and the developer is in the form of a layer on the face of a receiver sheet.

Another arrangement of the components is that wherein the microcapsules which contain the color former, and the developer, are in or on the same sheet, in the form of one or more individual layers, or are present in the paper pulp.

The capsules are preferably secured to the support by means of a suitable adhesive. As paper is the preferred support, these adhesives are principally paper-coating agents, for example gum arabic, polyvinyl alcohol, hydroxymethyl cellulose, casein methyl cellulose, dextrin, starch or polymer latices. These latter are e.g. butadiene/styrene copolymers or acrylic homopolymers or copolymers.

The paper employed comprises not only normal paper made from cellulose fibres, but also paper in which the cellulose fibres are replaced (partially or completely) by synthetic polymers.

The metal complex compounds of the formula (1) may also be used in particular as developers in a thermoreactive recording material. This recording material usually contains at least one carrier, one color former, one electron acceptor and optionally also a binder and/or waxes. Thermoreactive recording systems comprise, for example, heat-sensitive recording and copying materials and papers. These systems are used e.g. for recording information, for example in electronic computers, teleprinters or telewriters, or in recording and measuring instruments, e.g. electrocardiographs. The image (mark) formation can also be effected manually with a heated pen. Laser beams can also be used to produce heat-induced marks. The thermoreactive recording material can be composed such that the color former is dispersed or dissolved in one binder layer and the developer is dissolved or dispersed in the binder in a second layer. Another possibility consists in dispersing both the color former and the developer in one layer. By means of heat the binder is softened at specific areas and the color former comes into contact with the developer at those points where heat is applied and the desired color develops at once. The developers of formula (1) may also be used in heat-sensitive recording materials by themselves, as mixtures, or in admixture with known developers.

It is known to use for this purpose the same developers as are used in pressure-sensitive papers, as well as phenolic compounds, for example 4-tert-butylphenol, 4-phenylphenol, 4-hydroxydiphenyl ether, α-naphthol, β-naphthol, 4-hydroxymethylbenzoate, 4-hydroxyacetophenone, 2,2'-dihydroxydiphenyl, 4,4-isopropylidenediphenol, 4,4'-isopropylidene-bis(2-methylphenol), 4,4'-bis(hydroxyphenyl)valeric acid, hydroquinone, pyrogallol, phloroglucinol, p-, m- and o-hydroxybenzoic acid, gallic acid, 1-hydroxy-2-naphthoic acid, as well as boric acid and organic, preferably aliphatic, dicarboxylic acids, for example tartaric acid, oxalic acid, maleic acid, citric acid, citraconic acid and succinic acid.

It is preferred to use fusible, film-forming binders for the production of the thermoreactive recording material. These binders are normally water-soluble, whereas the color formers and the developers are insoluble in water. The binder should be able to disperse and fix the color former and the developer at room temperature.

By applying heat the binder softens or melts, so that the color former comes in contact with the developer and a color is able to form. Examples of binders which are soluble, or at least swellable, in water are hydrophilic polymers, such as polyvinyl alcohol, polyacrylic acid, hydroxyethyl cellulose, methyl cellulose, carboxymethyl cellulose, polyacrylamide, polyvinyl pyrrolidone, gelatin, starch or etherified corn starch.

If the color former and the developer are in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, polymethylacrylates, ethyl cellulose, nitrocellulose and polyvinyl carbazole. The preferred arrangement, however, is that in which the color former and the developer are contained in one layer in a water-soluble binder.

The thermoreactive coatings may contain further ingredients. To improve the degree of whiteness, to facilitate the printing of papers, and to prevent the heated pen from sticking, the coatings may contain e.g. talcum, $TiO_2$, ZnO, $CaCO_3$ (e.g. chalk), clays, such as kaolin or also organic pigments, for example urea/formaldehyde polymers or melamine/formaldehyde polymers. In order to effect the color formation only within a limited temperature range, there may be added substances such as urea, thiourea, diphenyl thiourea, acetamide, acetanilide, stearyl amide, phthalic anhydride, metal chlorides, metal stearates, e.g. zinc stearate, phthalonitrile or other appropriate fusible products which induce the simultaneous melting of the color former and the developer. Thermographic recording materials preferably contain waxes, e.g. carnauba wax, montan wax, paraffin wax, polyethylene wax, or condensates of higher fatty acid amides and formaldehyde, or condensates of higher fatty acids and ethylenediamine.

The invention is illustrated by the following Examples, in which parts and percentages are by weight, unless otherwise indicated.

EXAMPLE 1

Thermographic system

Two dispersions A and B are first prepared.

Dispersion A is prepared by grinding:

8 g of the imidazole complex of zinc thiocyanate, 32 g of a 10% aqueous solution of polyvinyl alcohol 25/140, and 20 g of water, over 3 to 6 hours with balls to a particle size of 2–4 μm.

Dispersion B is prepared by grinding:

1 g of crystal violet lactone, 4 g of a 10% aqueous solution of polyvinyl alcohol 25/140, and 2 g of water, with balls to a particle size of 2–4 μm.

The two dispersions are then mixed.

The colorless mixture is coated with a doctor blade on paper having a weight of 50 g/m². The coating weight of the mixture is 3 g/m² (dry weight). The base color of the recording paper so obtained is neutral. A blue color develops rapidly at 125° C., with saturating being reached at 220° C.

The imidazole complex of zinc thiocyanate employed in this Example is prepared as follows:

14.4 g of zinc sulfate ($ZnSO_4.7H_2O$) and 29.2 g of potassium thiocyanate are dissolved in 250 ml of water. A solution of 6.8 g of imidazole in 200 ml of water is stirred into the above solution, whereupon a white precipitate forms immediately. The precipitate is isolated by filtration, washed with water and dried at 60° C. The reaction product so obtained has a melting point of 143°–145° C.

EXAMPLE 2

Preparation of a heat-sensitive recording material by the process described in Example 1, but using 8 g of a picoline complex of zinc thiocyanate in dispersion A instead of the imidazole complex. The base color of the recording paper is neutral. A blue color develops rapidly at 125° C., with saturation being reached at 220° C.

The picoline complex of zinc thiocyanate employed in this Example is prepared as follows:

14.4 g of zinc sulfate ($ZnSO_4.7H_2O$) and 29.2 g of potassium thiocyanate are dissolved in 500 ml of water. A solution of 9.3 g of 2-picoline in 150 ml of ethanol is stirred into the above solution, whereupon the reaction product precipitates immediately in the form of a white crystalline substance. The precipitate is isolated by filtration, washed with water and dried at 50° C. The picoline metal complex compound has a melting point of 148°–152° C.

EXAMPLE 3

Preparation of a heat-sensitive recording material by the process described in Example 1, but using 8 g of a pyridine complex of cadmium thiocyanate in dispersion A instead of the imidazole complex. The base color of the recording paper is neutral. A blue color develops rapidly at 125° C.

The pyridine complex of cadmium thiocyanate employed in this Example is prepared as follows:

10 g of cadmium chloride ($CdCl_2.H_2O$) and 29.2 g of potassium thiocyanate are dissolved in 500 ml of water. A solution of 7.9 g of pyridine in 50 ml of ethanol is stirred into the above solution, whereupon the reaction product precipitates at once in the form of a white crystalline substance. The precipitate is isolated by filtration, washed with water and dried at 70° C. The pyridine-cadmium complex compound has a melting point of 208°–210° C.

The metal complexes of the formula

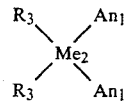

listed in the following table are obtained in the same manner as described in Examples 1–3 using the corresponding starting materials and under the reaction conditions likewise set forth in the table.

TABLE

| Example | $R_3$ | Me | $An_1$ | Reaction medium/ reaction temperature RT = room temperature | m.p./°C. |
|---|---|---|---|---|---|
| 4 | pyridine | Zn | SCN | water/ethanol RT | 190–192 |
| 5 | 3-picoline | Zn | SCN | water/ethanol RT | 161–163 |
| 6 | 2-methoxypyridine | Zn | SCN | water/ethanol RT | 117–119 |
| 7 | 1-methylimidazole | Zn | SCN | water/ethanol RT | 98–99 |
| 8 | 2-methylimidazole | Zn | SCN | water/ethanol RT | 162–164 |
| 9 | 3-picoline | Cd | SCN | water/ethanol RT | 157–158 |
| 10 | 3-picoline | Co | SCN | water/ethanol RT | 134–135 |
| 11 | 4-methylbenzyl-amine | Zn | SCN | water/ethanol RT | 142–143 |
| 12 | benzthiazole | Zn | SCN | water/ethanol RT | 190–191 |
| 13 | 3-picoline | Zn | Cl | water RT | 153–157 |
| 14 | aniline | Zn | Cl | water/ethanol RT | 250–252 |
| 15 | aniline | Zn | SCN | water/ethanol RT | 176–178 |
| 16 | 3-picoline | Zn | benzoate | isopropanol RT | |
| 17 | 2-mercaptobenz-thiazole | Zn | Cl | ethanol 70° C. | 225–229 |
| 18 | triphenylphos-phineoxide | Zn | SCN | n-butanol 110–115° C. | 215–217 |
| 19 | benztriazole | Zn | SCN | water 60° C. | >250 |
| 20 | octadecylamine | Zn | SCN | isopropanol 75° C. | |
| 21 | antipyrine | Zn | SCN | water RT | 112–113 |
| 22 | benzimidazole | Zn | SCN | water/ethanol RT | 160–162 |
| 23 | 1-methylimidazole | Zn | Cl | ethanol RT | 199–200 |
| 24 | benzimidazole | Zn | Cl | water/ethanol RT | 221–223 |
| 25 | 2-methylbenzimid-azole | Zn | acetate | methanol 64° C. | >240 |
| 26 | 1-vinylimidazole | Zn | SCN | water/ethanol RT | 104–105 |
| 27 | 2-aminobenzimid-azole | Zn | SCN | ethanol 78° C. | >240 |
| 28 | 2-phenylimidazole | Zn | SCN | water/ethanol RT | 198–199 |
| 29 | 1,2-dimethylbenz-imidazole | Zn | SCN | ethanol 78° C. | >240 |
| 30 | 2-stearylbenz-imidazole | Zn | SCN | ethanol 78° C. | 84–85 |
| 31 | 4-cyanopyridine | Zn | SCN | ethanol 78° C. | 180–181 |
| 32 | pyridine-4-aldehyde | Zn | SCN | water/ethanol RT | 190–191 |

TABLE-continued

| Example | $R_3$ | Me | $An_1$ | Reaction medium/ reaction temperature RT = room temperature | m.p./°C. |
|---|---|---|---|---|---|
| 33 | quinoline | Zn | SCN | water/ethanol RT | 203–204 |
| 34 | 2,2-bipyridyl | Zn | SCN | ethanol 78° C. | 231–232 |
| 35 | o-phenanthroline | Zn | SCN | ethanol 78° C. | >240 |
| 36 | 2-aminobenz-thiazole | Zn | SCN | water/ethanol RT | 191–193 |
| 37 | α-phenylethyl-amine | Zn | SCN | water/ethanol RT | 174–178 |
| 38 | diethylformamide | Zn | Cl | 100° C. | 101–102 |
| 39 | 1,3-dimethyl-imid-azoline-2-thion | Zn | SCN | ethanol 78° C. | 143–144 |
| 40 | tetramethylurea | Zn | SCN | 50° C. | 80–81 |

Good to excellent colorations which are lightfast and stable are obtained in heat-sensitive recording materials by using as color developers each of the metal complexes prepared according to Examples 4 to 40, following the same procedure as described in Examples 1 to 3.

EXAMPLE 41

Pressure-sensitive system 10 parts of the benzoimidazole complex of zinc thiocyanate prepared in Example 22, 30 parts of China clay, 1 part of naphthalenesulfonic acid/formaldehyde condensate, 10 parts of a styrene/butadiene copolymer (50%) and 70 parts of water are ground with balls to a granular size of 2–4 μm.

The resultant dispersion is coated with a doctor blade on base paper with a weight per unit area of 48 g/m². Coating weight: 6 g/m².

The above receiver sheet is laid face to face on a sheet of commercially available carbon paper. The donor sheet (CB-sheet) contains the dissolved color former, e.g. crystal violet lactone, in microcapsules. Writing by hand or typewriter produces an intense blue copy.

EXAMPLE 42

Pressure-sensitive system 10 parts of the methoxypyridine complex of zinc thiocyanate prepared in Example 6, 40 parts of China clay, 1 part of a naphthalenesulfonic acid/formaldehyde condensate, 8 parts of polyvinylalcohol and 12 parts of water are ground with balls to a granular size of 2–4 μm.

The resultant dispersion is coated with a doctor blade on base paper with a weight per unit area of 48 g/m². Coating weight: 6 g/m².

The above receiver sheet is laid face to face on a sheet of commercially available carbon paper. The donor sheet contains the dissolved color former, e.g. crystal violet lactone, in microcapsules. Writing by hand or typewriter produces an intense blue copy.

EXAMPLE 43

Pressure-sensitive system 1 part of the α-phenyl-ethylamine complex of zinc thiocyanate prepared in Example 37, 2 parts of China clay, 0.1 parts of naphthalenesulfonic acid/formaldehyde condensate, 0.7 parts of a styrene/butadiene copolymer (50%) and 18 parts of water are ground with balls to a granular size of 2–4 μm.

The resultant dispersion is coated with a doctor blade on base paper with a weight per unit area of 48 g/m². Coating weight: 3 g/m².

The above receiver sheet is laid face to face on a sheet of commercially available carbon paper. The donor sheet contains the dissolved color former, e.g. crystal violet lactone, in microcapsules. Writing by hand or typewriter produces an intense blue copy.

EXAMPLE 44

Pressure-sensitive system 1 part of the benzothiazole complex of zinc thiocyanate prepared in Example 12 is dissolved in 60 parts of acetone and stirred with 5 parts of China clay for 30 minutes. Afterwards the acetone is steamed off.

8 parts of the remaining mixture, 0.8 parts of a naphthalenesulfonic acid/formaldehyde condensate, 1.2 parts of a styrene/butadiene copolymer (50%) and 3 parts of polyvinylalcohol e.g. Polyviol VO3/140 and 12 parts of water are ground with balls to a granular size of 2–4 μm.

The resultant dispersion is coated with a doctor blade on base paper with a weight per unit area of 48 g/m². Coating weight: 6.5 g/m².

The above receiver sheet is laid face to face on a sheet of commercially available carbon paper. The donor sheet contains the dissolved color former, e.g. crystal violet lactone, in microcapsules. Writing by hand or typewriter produces an intense blue copy.

EXAMPLE 45

Pressure-sensitive system 10 parts of the picoline complex of zinc thiocyanate prepared in Example 2, 10 parts of China clay, 5 parts of a naphthalenesulfonic acid/formaldehyde condensate, 20 parts of a sytrene/butadiene copolymer (50%) and 300 parts of water are ground with balls to a granular size of 2–4 82 m.

The resultant dispersion is coated with a doctor blade on base paper with a weight per unit area of 48 g/m². Coating weight: 6 g/m².

The above receiver sheet is laid face to face on a sheet of commercially available carbon paper. The donor sheet contains the color former, e.g. crystal violet lactone, dissolved in microcapsules. Writing by hand or typewriter produces an intense blue copy.

What is claimed is:

1. A pressure-sensitive or heat-sensitive recording material comprising a support having a developer or both a color former and a developer in or on the support, wherein the developer consists of a metal complex compound of the formula wherein Me is an n-valent metal ion, R is a unidentate or polydentate colorless organic ligand which is complexd with the metal ion through heteroatoms, An is a r-valent anion, k is the coordination number 4 or 6 of the metal ion, depending on the metal, n is 1, 2, 3 or 4, and r is 1 or 2.

2. A recording material of claim 1, wherein in the formula (1), Me is an ion of a divalent, trivalent or quadrivalent metal having an atomic weight of 24 to 210.

3. A recording material of claim 2, wherein the metal has an atomic weight of 40 to 140.

4. A recording material of claim 3, wherein the metal is zinc.

5. A recording material of claim 1, wherein in the formula (1) R is a unidentate or polydentate ligand which is complexed with the metal ion through nitrogen atoms.

6. A recording material of claim 5, wherein in the formula (1) R is a 5- or 6-membered aromatic N-heterocyclic ring which is complexed with the metal ion through the nitrogen atom and which is unsubstituted or mono- or disubstituted by hydroxy, cyano, $C_1$–$C_4$ alkyl, $C_1$–$C_4$alkoxy, vinyl, phenyl, $C_1$–$C_4$acyl or amino groups, or is fused to a benzene ring which is unsubstituted or mono- or disubstituted by halogen, $C_1$–$C_4$alkyl or $C_1$–$C_4$alkoxy.

7. A recording material of claim 1, wherein in the formula An is a halide, thiocyanate, nitrate, sulfate, phosphate, borate, formate, acetate, propionate, stearate, benzoate, oxalate, citrate or phthalate ion.

8. A recording material of claim 7, wherein in the formula An is a thiocyanate ion.

9. A recording material of claim 1, which comprises a color developer of the formula

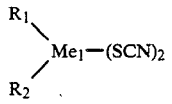

(2)

wherein $Me_1$ is an ion of a divalent, trivalent or quadrivalent metal having an atomic weight of 40 to 140 and each of $R_1$ and $R_2$ independently of the other is a unidentate 5- or 6-membered N-heterocyclic ring system of aromatic character which is complexed with the metal ion through the nitrogen atom and which is unsubstituted or mono- or disubstituted by methoxy, $C_1$–$C_4$alkyl, cyano, vinyl, formyl, phenyl or amino groups, or is fused to a benzene ring.

10. A recording material of claim 9, wherein in the formula $Me_1$ is the divalent zinc ion or cadmium ion, and each of $R_1$ and $R_2$ is a pyridine, imidazole, quinoline, benzimidazole or benzothiazole ligand which is complexed through a nitrogen atom and in which the N-heterocyclic ring is unsubstituted or mono-substituted by methyl, methoxy, cyano, vinyl, formyl, phenyl or amino.

11. A recording material of claim 10, wherein in the formula $Me_1$ is the divalent zinc ion and each of $R_1$ and $R_2$ is a 1-methylimidazole or 2-methylimidazole ligand.

12. A recording material of claim 9, wherein in the formula $Me_1$ is the divalent zinc ion and each of $R_1$ and $R_2$ is a pyridine, 2-methoxypyridine, picoline, imidazole, quinoline, benzimidazole or benzothiazole ligand which is complexed through a nitrogen atom.

13. A recording material of claim 12, wherein in the formula $Me_1$ is the divalent zinc ion and each of $R_1$ and $R_2$ is a benzothiazole ligand.

14. A heat-sensitive recording material of claim 9 which comprises, in at least one layer, a color former, a developer and a binder.

15. A recording material of claim 1 wherein in the formula Me is a divalent zinc ion and R is a α-phenylethylamine ligand.

16. A pressure-sensitive recording material of claim 1 which contains a color former dissolved in an organic solvent.

17. A pressure-sensitive recording material of claim 16, wherein the color former is encapsulated in microcapsules.

18. A pressure-sensitive recording material of claim 17, wherein the encapsulated color former is applied in the form of a layer to the back of a transfer sheet and the developer of the formula of claim 1 is applied in the form of a layer to the face of a receiver sheet.

19. A pressure-sensitive recording material of claim 17, wherein the encapsulated color former is applied in the form of a layer to the back of a transfer sheet and the developer is applied in the form of a layer to the face of a receiver sheet.

20. A heat-sensitive recording material of claim 1 which comprises, in at least one layer, a color former, a developer and a binder.

21. A pressure-sensitive or heat-sensitive recording material of claim 1 which further contains a different color developer.

* * * * *

UNITED STATES PATENT AND TRADEMARK OFFICE

CERTIFICATE OF CORRECTION

PATENT NO. : 4,513,302

DATED : April 23, 1985

INVENTOR(S) : Rosalinde Braun

It is certified that error appears in the above-identified patent and that said Letters Patent is hereby corrected as shown below:

Claim 1, Column 13, line 8 should read--
compound of the formula
(1) $(R)_{k-n}Me(An)_{n/r}$ wherein --.

Claim 1, Column 13, Line 11 should read-- ligand which is complexed with the metal ion --.

Signed and Sealed this

*Fifteenth* Day of *October 1985*

[SEAL]

*Attest:*

*Attesting Officer*

DONALD J. QUIGG

*Commissioner of Patents and Trademarks—Designate*